United States Patent [19]

Kato et al.

[11] Patent Number: 4,557,114

[45] Date of Patent: Dec. 10, 1985

[54] CONTROL CIRCUIT FOR AIR CONDITIONER

[75] Inventors: Takashi Kato; Tomio Yoshikawa, both of Shimizu; Keiji Sato, Shizuoka; Kazuo Yoshioka, Shimizu, all of Japan

[73] Assignee: Hitachi, Ltd., Tokyo, Japan

[21] Appl. No.: 619,539

[22] Filed: Jun. 11, 1984

[30] Foreign Application Priority Data

Jun. 15, 1983 [JP] Japan ..... 58-105803

[51] Int. Cl.[4] ..... F25B 49/00

[52] U.S. Cl. ..... 62/126; 62/230; 361/22

[58] Field of Search ..... 62/154, 125, 126, 127, 62/129, 230; 340/664; 361/22, 23, 31

[56] References Cited

U.S. PATENT DOCUMENTS 4,307,775 12/1981 Saunders et al. ..... 62/127 X
4,449,375 5/1984 Briccetti ..... 62/126 X
4,463,571 8/1984 Wiggs ..... 62/126

FOREIGN PATENT DOCUMENTS 55-20305 2/1980 Japan .
55-31476 7/1980 Japan .

*Primary Examiner*—Harry Tanner
*Attorney, Agent, or Firm*—Antonelli, Terry & Wands

[57] ABSTRACT

In an air conditioner separated into an indoor unit and an outdoor unit, a control circuit comprises a three-phase power source connected in common to the indoor and outdoor units, and a signal line led out from two phases of the power source. A contact of an electromagnetic relay energizing a compressor of the air conditioner is connected on the portion of the signal line in the indoor unit in series with a current sensor sensing the current flowing through the signal line, and a contact of a protective relay protecting the compressor is connected on the portion of the signal line in the outdoor unit in series with the electromagnetic relay. A first controller is disposed in the indoor unit for controlling on-off of the relay contact of the electromagnetic relay, and a second controller is disposed in the outdoor unit for energizing the protective relay contact thereby controlling on-off of the compressor.

15 Claims, 6 Drawing Figures

CONTROL CIRCUIT FOR AIR CONDITIONER

BACKGROUND OF THE INVENTION

This invention relates to air conditioners, and more particularly to a control circuit for an air conditioner in which signal lines are connected between its indoor and outdoor units for controlling the operation of the air conditioner.

In an air conditioner of separate type in which an outdoor unit containing an air compressor, a blower, a four-way selector valve, an outdoor heat exchanger, etc. therein is disposed separately from an indoor unit containing a blower, an expansion valve, an indoor heat exchanger, etc., power is supplied from an AC three-phase power source common to the indoor and outdoor units, and lines connected to an actuating circuit are led out from two phases of the AC three-phase power source. When the AC three-phase power source is a high-voltage one, the voltage is transformed into a low voltage by a transformer, while when it is a low-voltage one, the voltage is supplied intact to actuate the individual components. Accordingly, one of the lines led out from the two phases functions as a common line, and an electromagnetic contactor for compressor operation, electromagnetic contactors for blower operation, four-way selector valve, various solenoid valves, etc. are connected to the other line. These contactors and valves must be connected in parallel to prevent voltage drops across their coils.

In order to operate the individual components of the indoor and outdoor units by application of signals, a signal line transmitting a signal commanding the operation of the compressor and another signal line transmitting a control signal controlling the four-way selector valve are required for signal transmission from the indoor unit to the outdoor unit, and also a signal line transmitting a signal indicative of operation of a protective equipment such as a sensor sensing an overcurrent of the compressor and another signal line transmitting a signal indicative of defrosting operation of a deicer are required for signal transmission from the outdoor unit to the indoor unit.

In a transmission circuit transmitting such voltage signals, each of the signals occupies one signal line, and a common line is additionally required. This means that the number of signal lines increases in proportion to the number of signals. Therefore, such a signal transmission circuit has been defective in that material and construction costs increase inevitably, and yet the probability of misconnections during wiring is still high.

With a view to obviate the above defect and in an attempt to decrease the number of signal transmission lines between the indoor and outdoor units, Japanese Utility Model Publication No. 55-31476 (1980) and Japanese Patent application Laid-open No. 55-20305 (1980) were proposed.

In the former or Japanese UM Publication No. 55-31476, a semiconductor deicer is divided into an indoor part and an outdoor part which are connected by a DC signal line, and a significant signal whose significance depends on its output level is transmitted over this signal line. Therefore, a complex device is required for the transmission and reception of the significant signal.

In the latter or Japanese Patent Application Laid-open No. 55-20305, an air conditioner is divided into an indoor unit and an outdoor unit which are connected by two DC signal lines, and a significant signal in the form of a pulse signal is transmitted over the signal lines. Therefore, in this case too, a complex device is required for the transmission and reception of the significant signal, as in the former case.

SUMMARY OF THE INVENTION

It is a primary object of the present invention to provide an air conditioner control circuit in which signals indicative of the sensed values of voltage and current are transmitted over a single signal line thereby minimizing the number of signal transmission lines.

In accordance with the present invention which attains the above object, there is provided a control circuit for an air conditioner of the type separated into an indoor unit and an outdoor unit which are connected to a power source and between which a signal line is connected for the control of the air-conditioner operation, the control circuit comprising a three-phase power source common to the indoor and outdoor units; a signal line led out from two phases of the three-phase power source; a contact of an electromagnetic relay energizing a component of the air-conditioner, the contact being connected on the portion of the signal line in the indoor unit in series with current sensor means sensing the current flowing through the signal line; a contact of a protective relay protecting the air-conditioner component, the contact being connected on the portion of the same signal line in the outdoor unit in series with the electromagnetic relay; a first controller disposed in the indoor unit for controlling the relay contact of the electromagnetic relay energizing the air-conditioner component; and a second controller disposed in the outdoor unit for energizing the protective relay contact thereby controlling on-off of the air-conditioner component.

The above structure permits bilateral transmission of two different kinds of signals, that is, a voltage signal and a current signal over a single signal line, and, since any especial significant signals are not transmitted, there is no need for provision of a special device such as a signal converter, the structure of the control circuit can be simplified.

A DC power source has been required for the purpose of transmission of a special significant signal such as a pulse signal. In contrast, in the present invention, a signal to be transmitted is not a significant one. Therefore, the present invention is featured in that the power source may be of either a DC type or an AC type, and a voltage signal and a current signal can be bilaterally transmitted over a single signal line.

Therefore, in the case of an air conditioner designed for the exclusive purpose of air cooling using an AC three-phase power source, its indoor and outdoor units are connected by a single common signal line led out from, for example, the R-phase of the three-phase power source, and, in the case of an air conditioner of heat pump cycle type using a four-way selector valve, a signal line for controlling the air compressor and another signal line for controlling the four-way selector valve are merely required.

It is possible, of course, to derive DC power from a three-phase AC power source through a transformer and to use a DC signal line for signal transmission. In such a case, however, the device may become slightly complex due to the provision of the transformer.

DESCRIPTION OF THE PREFERRED EMBODIMENTS

Figure 1:
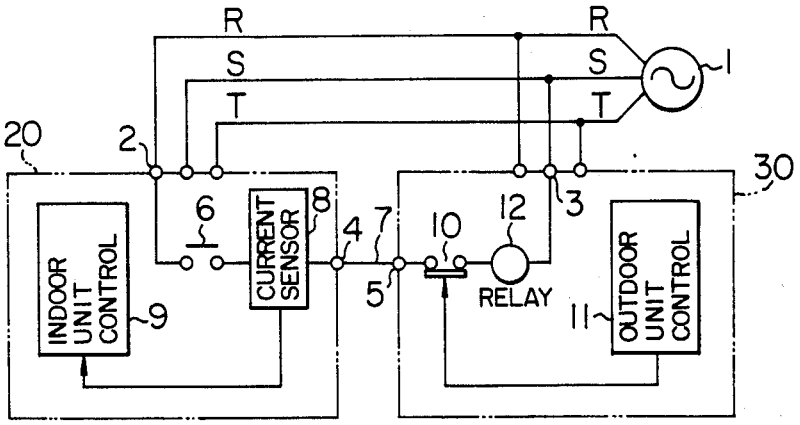
FIG. 1 is a circuit diagram of an embodiment of the control circuit of the present invention when applied to an air conditioner designed for the exclusive purpose of air cooling using an AC power source.

A preferred embodiment of the present invention will be described with reference to FIGS. 1 to 3. FIG. 1 shows an application of the present invention to an air conditioner designed for the exclusive purpose of air cooling.

Referring to FIG. 1, the air conditioner is separated into an indoor unit 20 and an outdoor unit 30 which are connected in common to an AC three-phase power source 1. Between an R-phase terminal 2 of the indoor unit 20 and an S-phase terminal 3 of the outdoor unit 30, a single signal line 7 is connected through terminals 4 and 5. In the portion of the signal line 7 between the terminals 2 and 4 in the indoor unit 20, an a-contact 6 of a DC relay energizing an electromagnetic relay 12 energizing a compressor 31 (FIG. 2) is connected in series with a current sensor 8. In the portion of the same signal line 7 between the terminals 5 and 3 in the outdoor unit 30, a contact 10 of an electromagnetic relay (not shown) protecting the compressor 31 is connected in series with the compressor-energizing electromagnetic relay 12. Reference numerals 9 and 11 designate an indoor unit controller and an outdoor unit controller respectively.

Figure 2:
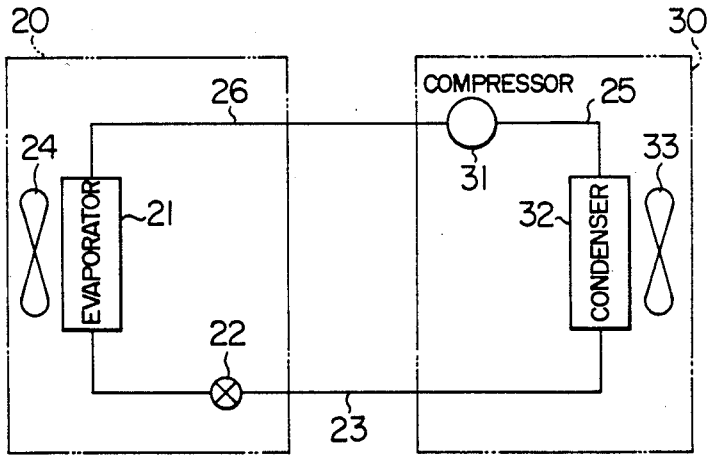
FIG. 2 is a piping diagram for effecting the refrigeration cycle for air cooling by the air conditioner which is separated into an indoor unit and an outdoor unit as shown in FIG. 1.

FIG. 2 is a piping diagram for effecting the refrigeration cycle of the air conditioner of separate type separated into the indoor unit 20 and the outdoor unit 30. Referring to FIG. 2, an expansion valve 22 is connected by a refrigerant conduit 23 to the inlet of an evaporator 21. A blower 24 is disposed in the indoor unit 20. The compressor 31 which may be any one of the reciprocating, screw and scroll types is disposed in the outdoor unit 30 which is connected at its delivery side to the inlet of a condenser 32 by a conduit 25. A blower 33 is also disposed in the outdoor unit 30. The compressor 31 in the outdoor unit 30 is connected at its suction side to the outlet of the evaporator 21 in the indoor unit 20 by a conduit 26 to complete the piping system for effecting the refrigeration cycle.

Figure 3:
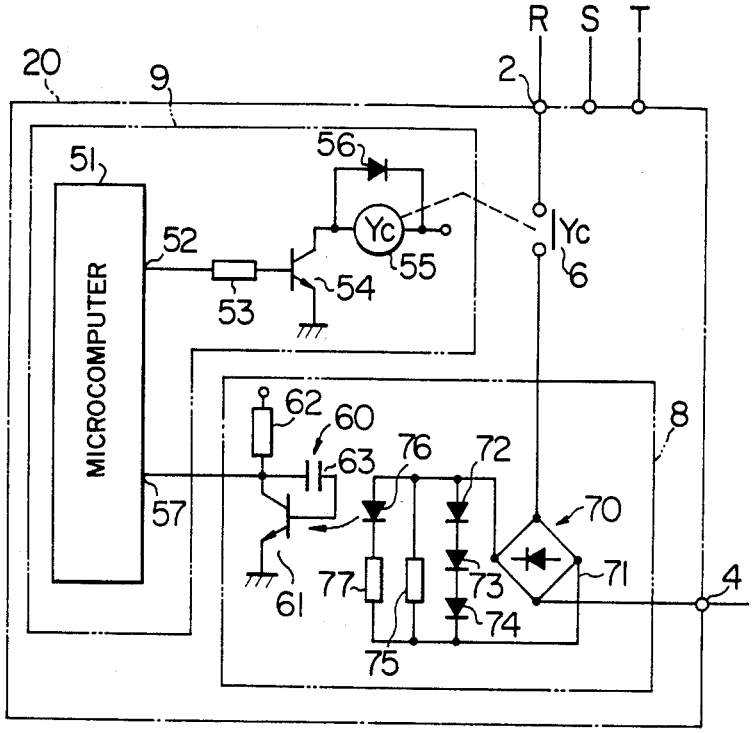
FIG. 3 shows in detail the structure of the current sensor and indoor unit controller in the indoor unit shown in FIG. 1.

FIG. 3 shows in detail the internal structure of the controller 9 and current sensor 8 in the indoor unit 20.

Referring to FIG. 3, the controller 9 includes a microcomputer 51, a resistor 53 connected to an output terminal 52 of the microcomputer 51, a transistor 54 connected to the resistor 53, and a parallel circuit of a DC relay 55 and a diode 56 connected to the transistor 54. The current sensor 8 includes a photo coupler 60 connected to an input terminal 57 of the microcomputer 51 and a rectifier 70. The photo coupler 60 includes a photo transistor 61, a resistor 62 and a capacitor 63, and the rectifier 70 includes a rectifying bridge 71, series-connected diodes 72, 73, 74, a resistor 75, and a series circuit of a light-emitting diode 76 and a resistor 77.

The operation of the control circuit having a structure as described above and applied to the air conditioner of the air-cooling purpose will now be described.

When the microcomputer 51 commands the operation of the air conditioner, the command signal energizes the DC relay 55 through the transistor 54, and the a-contact 6 of the DC relay 55 is closed. The closure of the a-contact 6 establishes a signal circuit in which the R-phase line is a common line. Since the contact 10 of the compressor protective relay is normally closed, power is supplied also to the current sensor 8 and compressor-energizing electromagnetic relay 12 thereby to start operation of the compressor 31. The high-temperature high-pressure refrigerant gas compressed by the compressor 31 in the outdoor unit 30 is fed into the condenser 32 by the conduit 25 and radiates heat as a result of heat exchange between it and external air supplied from the blower 33 to be condensed and liquefied. The condensed medium-temperature high-pressure refrigerant gas is then fed toward the indoor unit 20 by the conduit 23 and is expanded by the expansion valve 22 to turn into the low-temperature low-pressure refrigerant gas which is supplied to the evaporator 21. In the evaporator 21, the low-temperature low-pressure refrigerant gas makes heat exchange with room air supplied from the blower 24 so that heat is absorbed from room air to cool the air. The cooled air is discharged into the room again from the blower 24 to be utilized for air cooling. On the other hand, the refrigerant gas is drawn through the conduit 26 into the compressor 31 in the outdoor unit 30 to be compressed again. Such a manner of refrigerant circulation is repeated for cooling air in the room.

If an overcurrent is sensed by the outdoor unit controller 11 during the air cooling operation, the contact 10 of the compressor-protective electromagnetic relay is opened to interrupt flow of current through the signal line 7, and the compressor-energizing electromagnetic relay 12 is deenergized to stop the operation of the compressor 31. On the other hand, in response to the application of a signal from the photo coupler 60, which signal is indicative of the fact that light is not now emitted from the light-emitting diode 76 in the current sensor 8, the microcomputer 51 detects that no current is now flowing through the signal line 7 in spite of the fact that it has continuously generated the operation command signal. The microcomputer 51 judges then that an abnormal situation has occurred and displays the abnormal operation on a control panel.

However, when the user manipulates a switch on the control panel to instruct the microcomputer 51 to stop the operation of the air conditioner, the output signal from the microcomputer 51 opens the a-contact 6 of the DC relay 55 thereby deenergizing the compressor-energizing electromagnetic relay 12 to stop the operation of the compressor 31. In such a case, the microcomputer 51 does not judge that the operation is abnormal.

Thus, in such an air-cooling air conditioner, the common line is led out from the R-phase of an AC three-phase power supply, and the combination of a voltage signal and a current signal can be transmitted over a single signal line extending between the indoor unit and the outdoor unit for the control of the air-conditioner operation.

The operation control by the voltage and current signals transmitted over the single signal line can not only reduce the material and construction costs but also remarkably facilitate the wiring work thereby eliminating the probability of undesirable mis-wiring.

Provision of a reverse-rotation preventive relay connected to the relay contact 10 in the controller 11 in the outdoor unit 30 is effective especially when, for example, the compressor 31 is of the scroll type which is not absolutely adapted for reverse rotation. A dual pressure switch and a low pressure switch (not shown) are commonly provided to deal with an unusually high pressure and an unusually low pressure respectively and are connected to the relay contact 10 so as to ensure safer operation control.

Figure 4:
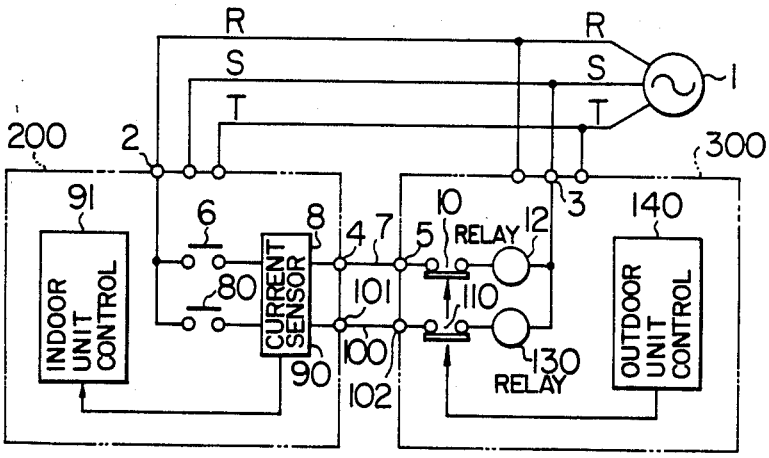
FIG. 4 is a circuit diagram of another embodiment of the control circuit of the present invention when applied to an air conditioner of heat pump type.
Figure 5:
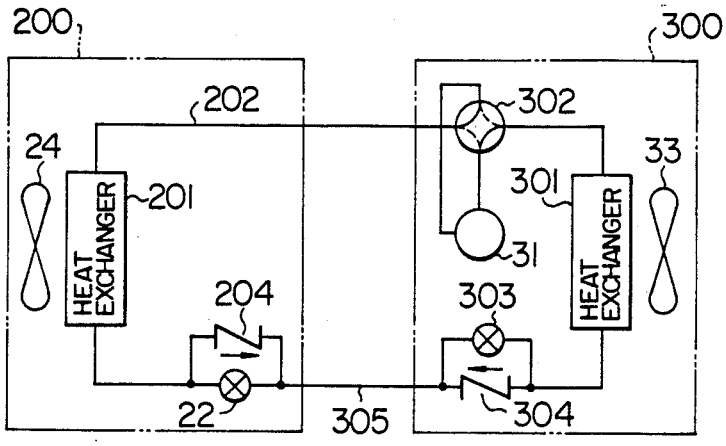
FIG. 5 is a piping diagram for effecting the refrigeration cycle for air conditioning by the air conditioner which is separated into an indoor unit and an outdoor unit as shown in FIG. 4.

FIGS. 4 and 5 are a control circuit diagram and a refrigeration cycle piping diagram respectively of another embodiment of the present invention when applied to an air conditioner of heat pump type. In FIGS. 4 and 5, the same reference numerals are used to designate the same or equivalent parts appearing in FIGS. 1 and 2 to dispense with any detailed description thereof.

Referring to FIGS. 4 and 5, another signal line 100 extends in parallel with the signal line 7 between a terminal 101 of an indoor unit 200 and a terminal 102 of an outdoor unit 300. The portion of the signal line 100 extending into the indoor unit 200 connects the terminal 101 to the terminal 2, and an a-contact 80 of a DC relay (not shown) energizing an electromagnetic relay 130 energizing a four-way selector valve 302 is connected in series with a current sensor 90 in this portion of the signal line 100. Also, the portion of the signal line 100 extending into the outdoor unit 300 connects the terminal 102 to the terminal 3, and the electromagnetic relay 130 energizing the four-way selector valve 302 is connected in series with a contact 110 of a deicer (not shown) in this portion of the signal line 100. A controller 91 disposed in the indoor unit 200 is the same as the controller 9 described with reference to FIG. 3 and is connected to the current sensor 90 connected in parallel with the current sensor 8. A controller 140 in the outdoor unit 300 includes a deicing command unit (not shown) connected in parallel with the protective relays including the overcurrent senser, reverse-rotation preventive relay, dual pressure switch and low pressure switch connected to the relay contact 10 of the compressor protective relay.

The four-way selector valve 302 is connected to the delivery side of the compressor 31. A heat exchanger 301 in the outdoor unit 300 functions as a condenser during air-cooling operation and as an evaporator during air-heating operation. An expansion valve 303 used in the heating operation is connected in parallel with a check valve 304 in the outdoor unit 300. This valve 303 is connected by a conduit 305 to the cooling-purpose expansion valve 22 and a check valve 204 in the indoor unit 200. A heat exchanger 201 in the indoor unit 200 functions as an evaporator during air-cooling operation and as a condenser during air-heating operation. A conduit 202 connects the heat exchanger 201 in the indoor unit 200 to the four-way selector valve 302 in the outdoor unit 300.

The operation of the control circuit controlling the air conditioner of the heat pump type will now be described with reference to the case where the air conditioner is operating for air heating. Under normal operation, the compressor 31 and four-way selector valve 302 operate under control of the controller 91 in the indoor unit 200 which applies control signals controlling on-off of the relay contacts 6 and 80. The compressor 31 is run until a predetermined temperature setting is reached, and the operation of the compressor 31 is stopped upon attainment of the set temperature. The four-way selector valve 302 is energized during the air heating operation of the refrigeration cycle and is deenergized during the defrosting operation. When the refrigeration cycle is placed under air cooling operation, the refrigerant flows in the solid-line direction through the four-way selector valve 302 and returns to the compressor 31 after flowing through the heat exchanger 301, check valve 304, conduit 305, cooling-purpose expansion valve 22, heat exchanger 201, conduit 202 and four-way selector valve 302. In the case of air-heating operation, the refrigerant flows in the reverse direction or dotted-line direction through the four-way selector valve 302 and returns to the compressor 31 after flowing through the conduit 202, heat exchanger 201, check valve 204, conduit 305, heating-purpose expansion valve 303, heat exchanger 301 and four-way selector valve 302.

The current sensors 8 and 90 disposed in the indoor unit 200 on the two signal lines 7 and 100 respectively apply their output signals each indicative of the current flow to the controller 91.

The controller 91 controls the operation of the air conditioner while confirming that the air conditioner is under normal operation as a result of comparison between the operation command signal commanding energization of the compressor-energizing relay 12 or four-way valve energizing relay 130 with the sensed current signal generated from the current sensor 8 or 90.

Then, when a defrosting control signal is generated from the controller 140 in the outdoor unit 300, the relay contact 110 is opened to interrupt the path of current from the R-phase to the S-phase, and the electromagnetic relay 130 energizing the four-way selector valve 302 is deenergized. The current sensor 90 informs the indoor unit controller 91 of the fact that current flow through this path is now ceased. At this time, there is no current flow in spite of the fact that the controller 91 in the indoor unit 200 is generating the signal energizing the four-way valve energizing relay 130. Therefore, the controller 91 judges that defrosting is proceeding now and executes the predetermined control. Upon completion of the defrosting, the controller 140 in the outdoor unit 300 generates a signal for turning on the relay contact 110, and the four-way selector valve energizing relay 130 is energized to re-start the air heating operation. In the indoor unit 200, the current sensor 90 senses the flow of current, since the defrosting is completed.

When the controller 140 in the outdoor unit 300 senses an overcurrent, the relay contact 10 is opened to deenergize the compressor-energizing electromagnetic relay 12 to stop the operation of the compressor 31. When the current senser 8 senses that there is no current flow in spite of generation of the compressor energizing signal from the controller 91 in the indoor unit 200, the controller 91 judges that the air conditioner operation is abnormal and executes the predetermined control.

During the air cooling operation, the four-way selector valve 302 does not operate, and the compressor 130 only is controlled. The steps of operation in this case are similar to those of the air heating operation described above.

It will thus be seen that, in the case of the air conditioner of the heat pump type, only two signal lines are required. (The common line is led out from the R-phase of the AC three-phase power source.)

Figure 6:
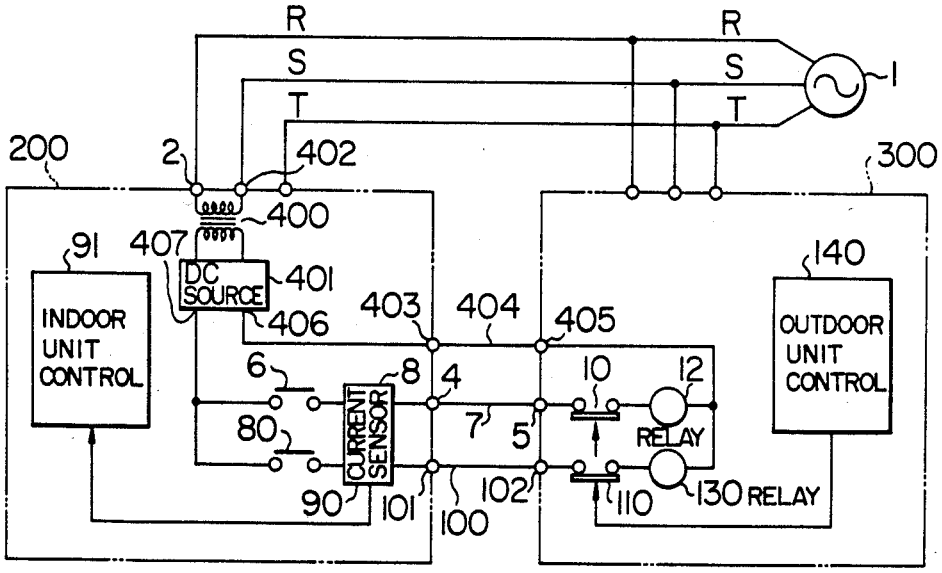
FIG. 6 is a circuit diagram of still another embodiment of the control circuit of the present invention in which the signal lines shown in FIG. 4 are connected to a DC power source.

FIG. 6 shows still another embodiment of the control circuit according to the present invention, in which signal lines are supplied from a DC power source.

Referring to FIG. 6 in which the same reference numerals are used to designate the same or equivalent parts appearing in FIG. 4, a transformer 400 is connected at its primary winding between terminals 2 and 402 (between the R phase and the S-phase) of the indoor unit 200, and a DC power source 401 is connected across the secondary winding of the transformer 402. A common line 404 extends from a terminal 406 of the DC power source 401 in the indoor unit 200 to a terminal 405 of the outdoor unit 300, and the signal lines 7 and 100 are led out from another terminal 407 of the DC power source 401 to be connected to the components including the relay contacts and current sensors described hereinbefore. Thus, when the signal lines 7 and 100 are supplied from the DC power source 401, the common line 404 is additionally required. In the case of the air conditioner of the heat pump type, therefore, the number of the signal lines including the common line is three.

Although the DC power source 401 and transformer 402 are disposed in the indoor unit 200 in FIG. 6, they may be disposed in the outdoor unit 300.

We claim:

1. A control circuit for an air conditioner separated into an indoor unit and an outdoor unit which are connected to a power source and between which a signal line is connected for the control of the air-conditioner operation, said control circuit comprising:

a three-phase power source common to said indoor unit and said outdoor unit;

a signal line led out from two phases of said three-phase power source;

a contact of an electromagnetic relay energizing a component of the air conditioner, said contact being connected on the portion of said signal line in said indoor unit in series with current sensor means sensing the current flowing through said signal line;

a contact of a protective relay protecting said air-conditioner component, said contact being connected on the portion of said same signal line in said outdoor unit in series with said electromagnetic relay;

a first controller disposed in said indoor unit for controlling the relay contact of said electromagnetic relay energizing said air-conditioner component; and a second controller disposed in said outdoor unit for energizing said protective relay contact thereby controlling on-off of said air-conditioner component.

2. A control circuit as claimed in claim 1, wherein one end of said signal line is led out from one of the phase terminating in said indoor unit, and the other end thereof is led out from another of the phases terminating in said outdoor unit.

3. A control circuit as claimed in claim 2, wherein said one of the phases terminating in said indoor unit is the R-phase, and said another of the phases terminating in said outdoor unit is the S-phase.

4. A control circuit as claimed in claim 1, wherein said signal line is led out from the two of the phases terminating in said indoor unit or said outdoor unit, and a transformer is provided for rectifying the AC power to provide a DC power source.

5. A control circuit as claimed in claim 1, wherein said air-conditioner component is a compressor of the air conditioner.

6. A control circuit as claimed in claim 1, wherein said air-conditioner component includes a compressor and a four-way selector valve of the compressor, and the relays energizing these components are connected to separate signal lines respectively.

7. A control circuit as claimed in claim 1, wherein said first controller disposed in said indoor unit includes a microcomputer for generating a component operation command signal, and means triggering a transistor in response to the operation command signal thereby energizing said relay contact of said electromagnetic relay energizing said air-conditioner component.

8. A control circuit as claimed in claim 1, wherein said second controller disposed in said outdoor unit includes means for sensing an overcurrent supplied to said compressor and means for generating a defrosting operation signal.

9. A control circuit as claimed in claim 1, wherein said current sensor means includes a rectifier bridge, a series circuit of a diode and a resistor, and a photo coupler applying the current signal to said microcomputer in response to the application of the output of said series circuit.

10. A control circuit as claimed in claim 1, wherein a common line is led out from the R-phase of said three-phase power source.

11. A control circuit as claimed in claim 4, wherein one of three lines led out from said DC power source to extend between said indoor unit and said outdoor unit is a common line, and the others are the signal lines.

12. A control circuit as claimed in claim 1, wherein said first controller generates a component operation command signal, means responsive to the component operation command signal for energizing said contact of said electromagnetic relay for closure thereof, said first controller being responsive to said current sensor means sensing that no current is flowing through said signal line when the component operation command signal is being generated for determining that an abnormal condition has occurred in the air conditioner.

13. A control circuit as claimed in claim 12, wherein said first controller stops generation of the component operation command signal upon determination that an abnormal condition has occurred.

14. A control circuit as claimed in claim 13, wherein said means responsive to the component operation command signal is responsive to the stopping of the generation of the component operation command signal for deenergizing said contact of said electromagnetic relay for enabling opening thereof.

15. A control circuit as claimed in claim 1, wherein said signal line is connected for enabling bilateral transmission of a voltage signal and a current signal therealong.

* * * * *